United States Patent [19]

Coppe et al.

[11] Patent Number: 4,465,086

[45] Date of Patent: Aug. 14, 1984

[54] SEALING DEVICE FOR A SHEET METAL TREATING MACHINE

[75] Inventors: Jacques Coppe, Grande Synthe; Pierre Lascoux, Plaisir, both of France

[73] Assignee: Union Siderurgique du Nord et de l'Est de la France, Paris, France

[21] Appl. No.: 338,513

[22] Filed: Jan. 11, 1982

[30] Foreign Application Priority Data

Jan. 9, 1981 [FR] France ..... 81 00289

[51] Int. Cl.[3] ..... B08B 3/02

[52] U.S. Cl. ..... 134/122 R; 266/113

[58] Field of Search ..... 134/64 R, 64 P, 122 R, 134/122 P, 9, 15; 266/112, 113; 49/477; 198/952; 312/31

[56] References Cited

U.S. PATENT DOCUMENTS

| | | | |
|---|---|---|---|
| 2,469,131 | 5/1949 | Ross | 49/477 |
| 2,720,011 | 10/1955 | Krupp | 49/477 |
| 2,731,220 | 1/1956 | Power | 49/477 |
| 3,397,490 | 8/1968 | Carlson | 49/477 |
| 4,064,884 | 12/1977 | Asp | 134/64 R |
| 4,185,648 | 1/1980 | Germain | 134/122 R |

FOREIGN PATENT DOCUMENTS

| | | |
|---|---|---|
| 2223096 | 10/1974 | France . |
| 2413139 | 7/1979 | France . |
| 2413140 | 7/1979 | France . |
| 2413141 | 7/1979 | France . |
| 2413467 | 7/1979 | France . |

*Primary Examiner*—Robert L. Bleutge

*Attorney, Agent, or Firm*—Cushman, Darby & Cushman

[57] ABSTRACT

The device is intended to facilitate the changing of the sealing element and to increase the life of this element. The device comprises an added bar which is detachably fixed to a wall of the machine and received in a slot in this wall. The bar carries a deformable hollow body which is connected to a source of fluid under pressure and carries the sealing element.

7 Claims, 4 Drawing Figures

SEALING DEVICE FOR A SHEET METAL TREATING MACHINE

DESCRIPTION

The present invention relates to treating machines and in particular machines for cooling metal sheets or the like, of the type comprising a lower frame and an upper frame in which frames there are mounted sets of sheet driving and guiding rolls which operate in pairs, the two frames defining an enclosure in which a treating fluid circulates. Such a machine is described in particular in French patent application No. 73 10710 filed Mar. 26, 1973 corresponding to French Pat. No. 2,223,096 published Oct. 25, 1974 and in French patent application Nos. 77 39833, 77 39834, 77 39835, 77 39836 filed on Dec. 30, 1977 published July 27, 1979 as U.S. Pat. Nos. 2,413,139; 2,413,140; 2,413,141 and 2,413,467, respectively.

There is described in particular in French Pat. No. 79 39835 the presence of a sealing element carried by an elastically yieldable strip which is fixed to the inner wall of the case of the upper frame which surrounds the driving and guiding roll which is the closest to an input or output end of the machine, this sealing element having in particular for function to avoid a phenomenon of unpriming the machine by the entry of air in the region located between the rolls and the upper part of the enclosure connected to conduits for discharging the treating liquid. This function is quite useful, but it has been found that, under the effect of friction against the roll, this sealing element undergoes relatively great wear and the fact of mounting it on an elastically yieldable metal strip does not enable this wear to be taken up. This phenomenon of wear is accentuated by the fact that the sealing element is constantly applied against the adjacent roll which rotates even when the machine operates as a simple roll table so as to avoid localised rises in temperature. Now, as they are fixed inside the case, these sealing elements are very difficult of access and in order to change them the adjacent roller must be dismantled, which results in a considerable loss of time.

An object of the invention is to provide an improvement for overcoming this problem and rendering these sealing elements much more accessible.

The invention accordingly provides a sealing device for a machine for treating metal sheets or like products, said machine comprising an upper frame and a lower frame defining an enclosure in which may circulate a treating fluid, said frames carrying sets of driving and guiding roller operating in pairs and comprising, in the vicinity of the input and output ends, at least one sealing element carried by a wall of the enclosure and cooperating with an adjacent roll. According to the invention, there is provided an added element which is detachably fixed to the outer surface of the wall of the enclosure and partly disposed in a slot formed in said wall and extending throughout the width of the machine, said added element comprising a sealing element adapted to cooperate with the roll.

According to other features:

the sealing element may be moved away from the roll;

for this purpose, it may be carried by a hollow deformable body connected to a source of fluid under pressure and carrying a sealing element proper made from a material having a low coefficient of friction;

the hollow body is secured to one surface of the added element which is located inside the enclosure in the position of use;

according to another embodiment, the hollow body is located outside the enclosure and carries a strip or bar which extends through a slot provided in the wall of the enclosure and penetrates the interior of the enclosure;

according to a modification, the added element comprises a body fixed to the lower frame of the machine, a sealing element carried slidably mounted in said body and carrying a sealing element, and an inflatable bead interposed between the body and the sealing element carrier and biasing the latter toward the adjacent roll in opposition to the action of elastically yieldable return means.

The invention will be described in more detail hereinafter with reference to the accompanying drawing which is given by way of example and in which.

Figure 1:
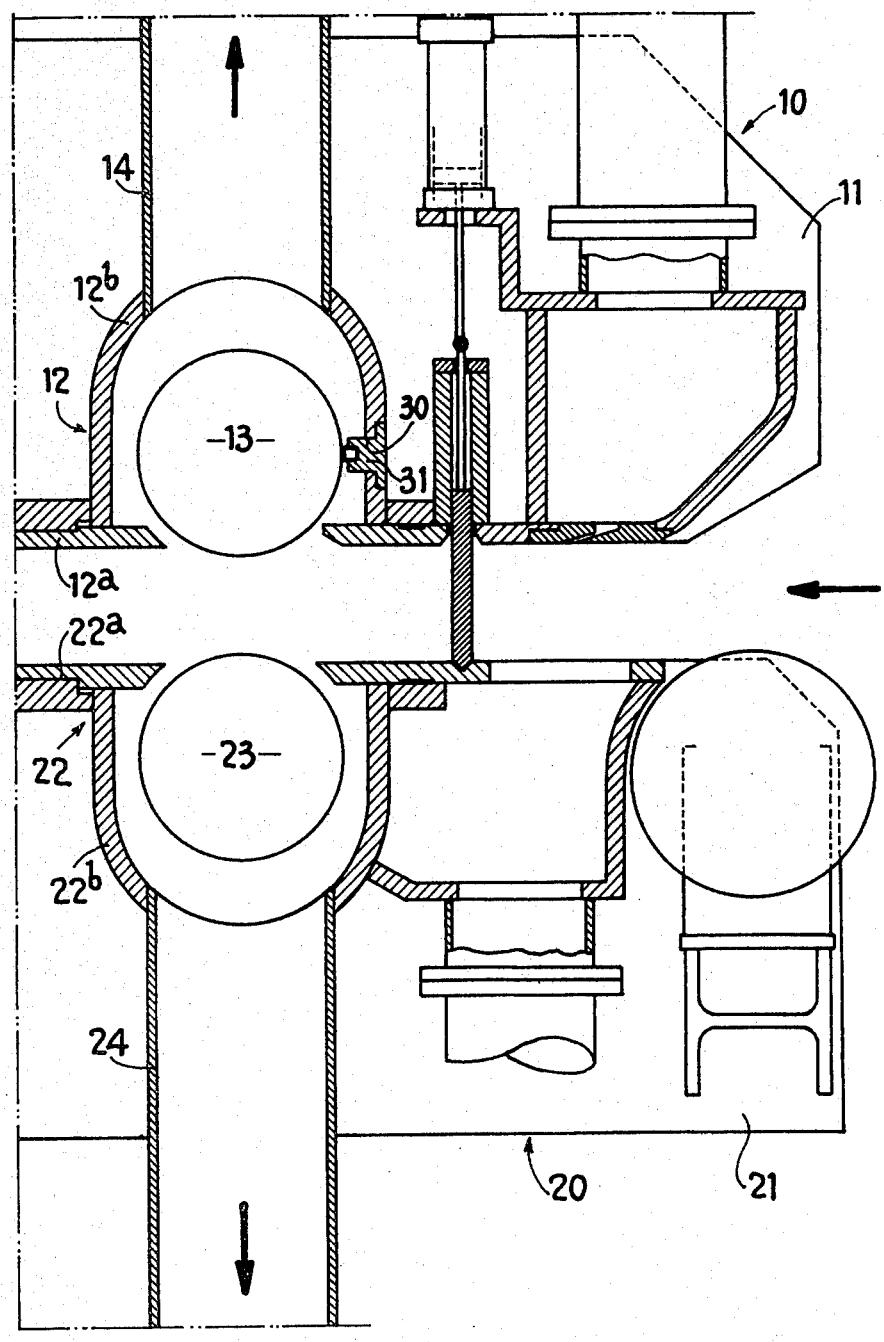
FIG. 1 is a sectional view of the input end of a metal sheet cooling machine.

FIG. 1 shows the input end of a machine for cooling metal sheets comprising an upper frame 10 and a lower frame 20. Each frame comprises side walls 11, 21 interconnected by metal cases 12, 22 comprising roughly planar portions **12*a*, 22*a* parallel to the sheet which passes through the machine, and curved portions 12*b*, 22*b* which surround the driving and guiding rolls 13, 23. The metal cases define an enclosure E in which a cooling liquid can circulate, the enclosure being for this purpose connected to liquid inlet and outlet pipes, the pipes 14, 24** shown in the drawing being outlet pipes.

Only the input end of the machine has been shown. It will be understood that the output end of the machine is, at least in the main, constructed in the same way.

Figure 2:
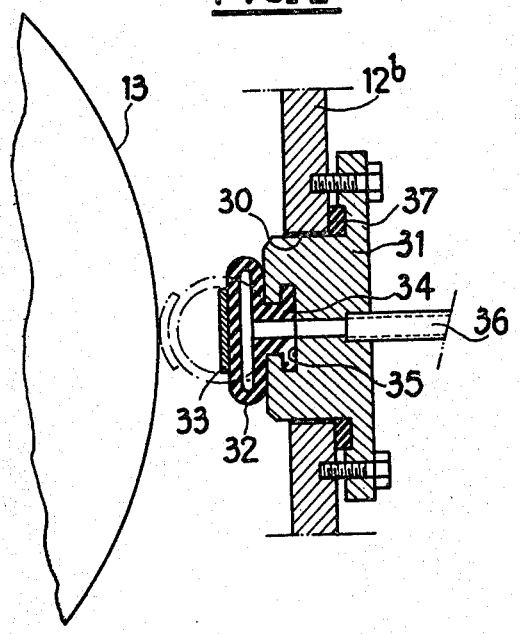
FIG. 2 is a detail view to an enlarged scale of a first embodiment of a sealing device according to the invention.

According to the invention, the case **12*b* comprises, roughly in the horizontal diametral plane of the end roll 13, a slot 30 which extends throughout the width of the machine and in which is received an added element constituted by a bar 31** of metal or of plastics material which is detachably fixed in a sealed manner to the case (FIG. 2). This fixing of the bar is accessible from outside the machine.

This added element which, in the illustrated embodiment, has a T-shaped cross-section, carries along the edge thereof disposed insie the case, a sealing element constituted by a hollow body or inflatable bead 32 made from an elastomeric material and carrying a wear layer 33 having a low coefficient of friction. This wear layer may be of "Teflon" or any other suitable material. The hollow body or bead 32 comprises a base 34 which enables it to be fixed in a groove 35 in the bar 31. In the free state, the bead has a flattened shape as shown in full lines in FIG. 2, and it is connected by a conduit 36 to a source of fluid under pressure, such as air or a liquid, which enables the bead to be given an inflated shape as shown in dot-dash lines.

Sealing elements 37 are provided between the bar 31 and the wall **12*b*** of the machine.

This bar may be made in a plurality of sections if desired.

Figure 3:
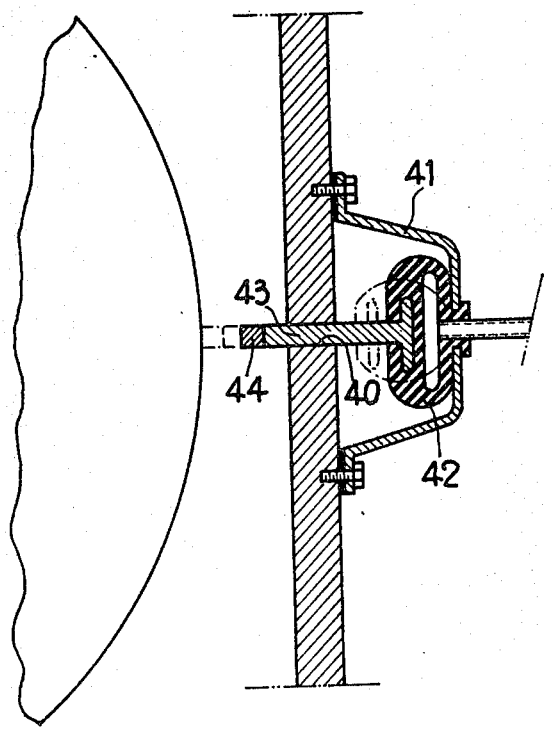
FIGS. 3 and 4 are views similar to FIG. 2 of two modifications.

In the embodiment shown in FIG. 3, the slot 40 formed in the wall **12*b* has less height than in the preceding embodiment and the sealing device comprises a housing or cap 41 which is detachably fixed in a sealed manner on the case 12***b* and carries a hollow body or inflatable bead 42 which is similar to that shown in FIG. 2. This bead is disposed outside the case and carries a strip or bar 43 which is relatively thin and extends through the slot 40 and projects inside this case. This strip may have at the end thereof a lining or layer 44 of a material having a low coefficient of friction, such as "TEFLON" or like material.

The operation of these arrangements is very simple. In the absence of a supply of fluid under pressure, the hollow body 32, 42 has a flattened shape and the sealing element is spaced away from the roll. On the other hand, the supply of fluid deforms the hollow body and brings the sealing element in sealing contact with the roll. In order to change the sealing element, the bar 31 or the cap 41 has merely to be removed and access to the sealing element is direct.

Figure 4:
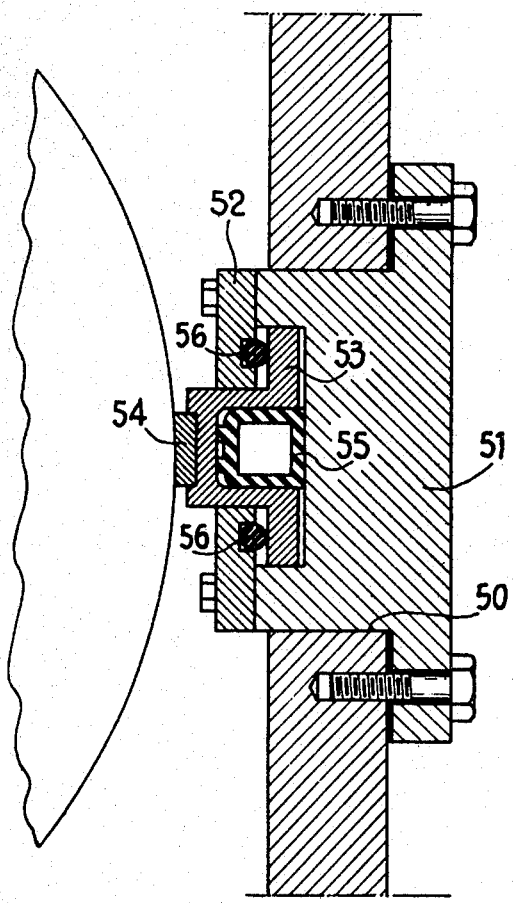

The variant shown in FIG. 4 comprises, disposed in a slot 50 of the upper frame, a body 51 of stainless steel completed by a closing plate 52. This body is secured in a detachable manner to the machine and extends throughout the width of the latter in a direction parallel to the axis of the roll.

A sealing element carrier 53 of bronze is slidable in the body 51, 52 and carries a sealing element 54 which is adapted to come in contact with the adjacent roll. The sealing element carrier has a T-shaped section and is biased toward the roll by means of an inflatable bead 55 in opposition to the action of two elastically yieldable elements or rings 56.

The operation of this embodiment is similar to that described in respect of the embodiment shown in FIG. 3.

In the contemplated three embodiments, the objects of the invention have been perfectly achieved:

there is provided a sealing device which effectively cooperates with the end rolls of the machine and is perfectly accessible from the exterior so that the sealing elements may be changed without necessity to dismantle the roll;

as this sealing element is withdrawable, it can be moved away from the rolls when the machine does not have cooling fluid passing therethrough so that wear of this sealing element is avoided;

the pressure with which the sealing element bears against the roll may be adjusted and wear taken up by supplying the required amount of fluid under pressure;

in the embodiment shown in FIG. 3, the slot required to be formed in the case is of smaller size and this constituted an additional advantage;

in the embodiment shown in FIG. 4, the guiding of the bar is improved and the changing of the wear element is facilitated.

It will be understood that the hollow body may have an inflated shape in the free state and be retracted by connecting it to a source of depression.

Having now described our invention what we claim as new and desired to secure by Letters Patent is:

1. A sealing device for a machine for treating metal sheets or the like and having an input end and an output end, said machine comprising an upper frame and a lower frame which have walls which define an enclosure in which enclosure a treating fluid can circulate, sets of rolls carried by said frames and provided for driving and guiding the sheets and operative in pairs, at least one sealing means in the vicinity of said input and output ends, each sealing means being carried by one of said walls defining the enclosure and being cooperative with an adjacent roll of said rolls and comprising a slot provided in said one wall and extending throughout the width of the machine an an added means which is detachably fixed to an outer surface of said one wall and partly disposed in said slot, said added means comprising a sealing element cooperative with the adjacent roll, shifting means for selectively shifting said sealing element between a position in which the sealing element is held against said adjacent roll and a retracted position in which said sealing element is spaced away from said adjacent roll, said shifting means comprising a deformable hollow body for connection to a source of fluid under pressure and carrying said sealing element, which sealing element is made from a material having a low coefficient of friction.

2. A device according to claim 1 wherein the hollow body is fixed to a side of said added means which is located inside the enclosure in the position of use.

3. A device according to claim 1 wherein the hollow body is located outside said enclosure and carries a strip which strip extends through said slot and projects inside said enclosure.

4. A device according to claim 2, wherein said added means comprises a cap.

5. A device according to claim 3, wherein said added means comprises a housing.

6. A device according to any one of the claims 1, 4 and 5, wherein the hollow body has in a free state thereof a flattened shape corresponding to said retracted position of said sealing element relative to said adjacent roll.

7. A device according to claim 1, wherein said added means comprises a second body fixed to the upper frame, a sealing element carrier slidably mounted in said body and carrying a said sealing element, and said deformable hollow body consists of an inflatable bead interposed between the sealing body and the sealing element carrier and elastically yieldable return means cooperative with said sealing element carrier for biasing said sealing element carrier away from said adjacent roll.

* * * * *